US006832706B2

(12) United States Patent
Hearld et al.

(10) Patent No.: US 6,832,706 B2
(45) Date of Patent: Dec. 21, 2004

(54) DISPENSING CLOSURE

(75) Inventors: Coy Hearld, Crawfordsville, IN (US); Lawrence Smeyak, Crawfordsville, IN (US); Hassan Najdawi, Crawfordsville, IN (US); David Babcock, Crawfordsville, IN (US); Ramesh Kamath, Crawfordsville, IN (US); Mark Powell, Crawfordsville, IN (US); Zinovy Royzen, Seattle, WA (US)

(73) Assignee: Alcoa Closure Systems International, Crawfordsville, IN (US)

( * ) Notice: Subject to any disclaimer, the term of this patent is extended or adjusted under 35 U.S.C. 154(b) by 46 days.

(21) Appl. No.: 10/340,319

(22) Filed: Jan. 10, 2003

(65) Prior Publication Data

US 2004/0134940 A1 Jul. 15, 2004

(51) Int. Cl.[7] ..... B65D 25/40
(52) U.S. Cl. ..... 222/494; 222/482
(58) Field of Search ..... 222/212, 481.5, 222/482, 494, 153.14, 556, 545; 137/852, 854

(56) References Cited

U.S. PATENT DOCUMENTS 3,059,816 A * 10/1962 Goldstein ..... 222/109
4,785,978 A * 11/1988 Kano et al. ..... 222/482
4,976,364 A * 12/1990 Solomon ..... 215/229
5,169,035 A * 12/1992 Imbery, Jr. ..... 222/212
5,271,432 A * 12/1993 Gueret ..... 137/854
5,454,488 A * 10/1995 Geier ..... 222/95
5,465,872 A * 11/1995 Gueret ..... 222/95
6,050,445 A * 4/2000 Manganiello ..... 220/714
6,062,436 A * 5/2000 Fuchs ..... 222/212
6,296,130 B1 * 10/2001 Forsyth et al. ..... 215/219
6,616,012 B2 * 9/2003 Dark ..... 222/1
2003/0085240 A1 * 5/2003 Dark ..... 222/494
2003/0094467 A1 * 5/2003 Dark ..... 222/484

* cited by examiner

*Primary Examiner*—Gene Mancene
*Assistant Examiner*—Patrick Buechner
(74) *Attorney, Agent, or Firm*—Stephen D. Geimer

(57) ABSTRACT

A dispensing closure assembly includes an outer closure body having an upper tubular portion which can function as a mouthpiece for users. The closure assembly includes a flexible valve member mounted within the tubular portion of the closure body for dispensing of liquids or like contents by either the application of suction by a consumer, or by squeezing the associated container. By the provision of a liquid seal lip which coacts with an inside surface of the flexible valve member, the closure assembly can be configured to facilitate convenient use by consumers, while avoiding undesirable leakage attendant to normal handling during use.

16 Claims, 11 Drawing Sheets

DISPENSING CLOSURE

TECHNICAL FIELD

The present invention relates generally to a dispensing closure for a container for dispensing liquids such as beverages, or other flowable materials, and more particularly to a dispensing closure configured to facilitate convenient use by consumers by either suction on the closure or by squeezing of the associated container, while avoiding inadvertent leakage of the container contents such as attendant to normal handling of the container.

BACKGROUND OF THE INVENTION

Dispensing closures have become increasingly popular with consumers for all manner of flowable materials, including beverages, condiments, and the like. In a typical construction for beverages, a dispensing closure includes a valve structure having a valve element which can be manually moved between opened and closed positions, with the closure permitting dispensing of the container contents either by suction or by container squeezing when in the open position. U.S. Pat. No. 5,975,369, hereby incorporated by reference, illustrates a dispensing closure which is typical of this type of construction.

While the above type of dispensing closure has met with widespread consumer acceptance, it will be appreciated that the use of the closure mandates manipulation and manual positioning of the valve structure between opened and closed positions. This can sometimes detract from convenient use of the closure, since sometimes it can be desirable to be able to dispense liquid either by the application of suction, or by squeezing of the container, without first manipulating the valve structure of the closure.

Efforts have been made to provide dispensing closures which avoid the need for manipulation, and which permit dispensing either by application of suction, or squeezing of the associated container. In such arrangements, it has been determined that the valve arrangement should open easily at suction pressures less than −0.38 pounds per square inch (psi), which has been determined to be the upper limit of the comfort range for the suction applied to a closure by a typical consumer. The problem associated with current technology is that such closures work via a pressure differential created across the valve structure. However, the leakage threshold for such a closure and container package is limited to the level of suction that can be comfortably applied by the typical consumer (i.e., less than 0.38 psi). Under normal use relative to typical temperatures, package orientation, vibration, and transportation, internal container liquid pressures greater than 0.38 psi are typically encountered, and thus the package can leak liquid, and in fact, would be expected to leak liquid by virtue of the design.

Accordingly, it is desirable to provide a dispensing closure with a cost-effective valve system that creates different opening pressure thresholds when comparing the vacuum developed through suction, and the internal fluid pressure developed within the package. It is desirable to have the opening threshold developed due to internal liquid pressure be substantially greater than the opening threshold developed due to suction provided by the consumer. This will provide the desired convenient use by a consumer, permitting dispensing either by suction or by container squeezing, while avoiding undesirable leakage of the package under conditions typically encountered during use.

SUMMARY OF THE INVENTION

The present invention is directed to a dispensing closure assembly for a container which is specifically configured to facilitate convenient use by consumers. A valve structure of the closure assembly is actuated by a pressure differential created across the valve structure, which pressure differential can be created either via suction by the consumer, or by an increase in internal liquid pressure due to squeezing by the consumer. Notably, the closure assembly is configured such that internal liquid pressures typically created during ordinary handling and use of the container are insufficient to open the valve structure, thus avoiding undesirable leakage of the closure assembly.

In accordance with the illustrated embodiments, the present dispensing closure assembly for a container comprises an outer closure body including an upper tubular portion, and a lower skirt portion configured for attachment to an associated container. The assembly further includes a central support stem positioned within the tubular portion, and a flexible valve member positioned in the tubular portion.

One of the support stem and the tubular portion define an annular valve seat, with the flexible valve member extending from the other of the support stem and tubular portion so that it bears against the valve seat in a first, closed position of the flexible valve member. The flexible valve member is movable from the first, closed position to a second position, wherein at least a portion of the periphery of the valve member is spaced from the valve seat to permit flow through the tubular portion.

In accordance with the present invention, a liquid seal lip extends from the one of the support stem and the tubular portion which defines the valve seat. The liquid seal lip is configured for engagement with the flexible valve member intermediate: (1) the other of the support stem and tubular portion; and (2) the valve seat, to limit the surface area of the valve member against which the liquid pressure within the container acts.

In certain illustrated embodiments, the present dispensing closure assembly includes an outer closure body including an upper tubular portion, and a lower skirt configured for attachment to an associated container. A valve retainer comprising the central support stem is positioned within the tubular portion of the outer closure body, with a disc-shaped flexible valve member positioned on the support stem, and extending from the support stem outwardly to a peripheral valve seat defined by the tubular portion.

The valve member is movable from a first, closed position in which the valve member bears against the valve seat, to a second, opened position wherein at least a portion of the periphery of the valve member is spaced from the valve seat to prevent flow through the tubular portion.

In order to provide the desired operational characteristics for the present closure assembly, these embodiments of the assembly include a liquid seal lip extending inwardly of the valve seat for engagement with a lower surface of the flexible valve member intermediate the support stem and the valve seat. The liquid seal lip acts to limit the surface area of the valve member against which pressure within the container acts. Notably, the liquid seal lip is intended to provide a liquid seal only, and permits the interior surface of the valve member to always be minimally exposed to atmospheric pressure.

Depending upon the specific orientation of the valve retainer within the upper tubular portion of the outer closure body, the valve member can extend generally downwardly from the support stem to the valve seat in the closed position thereof, and the valve member may be generally conic. In some applications, the valve member will be generally flat (i.e., non-conic) or may extend generally upwardly to the valve seat.

In accordance with one illustrated embodiment, the valve retainer comprises a separate component positioned within the outer closure body, with the valve retainer comprising an outer tubular portion, and at least one radially oriented bridge element for joining the support stem to the outer tubular portion.

In the preferred embodiment, the outer closure body defines an air vent passage for venting air into the container during liquid flow outwardly through the upper tubular portion. When a vent passage is provided, the closure assembly preferably includes a vent seal member positioned beneath the upper tubular portion of the outer closure body for closing the air vent passage.

For many applications, it can be desirable to provide an outer protective cover for the region through which liquid is dispensed, and to this end, the closure assembly can include a dust cover joined to the outer closure body. The dust cover comprises a cover portion for movement between a closed position covering the upper tubular portion, and an open position exposing the upper tubular portion for dispensing. When the dust cover is formed separately from the outer closure body, the dust cover can include a mounting ring for snap fitment to the outer closure body, with the cover portion being hingedly joined to the mounting ring. In the preferred form, the cover portion includes at least one locking element for cooperating engagement with the upper tubular portion of the closure body to releasably retain the cover portion in the closed position thereof.

When the closure assembly includes an air vent passage for venting air into the container, it is preferred to provide the dust cover with a vent block element for closing the vent passage in the closed position of the cover portion of the dust cover.

In another illustrated embodiment of the present invention, the flexible valve member of the closure assembly is annular (i.e., ring-shaped), and defines a central opening at its periphery. The valve member extends inwardly from the tubular portion of the closure body to the valve seat, which is defined by the central support stem of the assembly. This embodiment provides a stream-like flow of liquid as it is dispensed from the container through the central opening defined by the flexible valve member.

Other features and advantages of the present invention will become readily apparent from the following detailed description, the accompanying drawings, and the appended claims.

DETAILED DESCRIPTION

Figure 1:
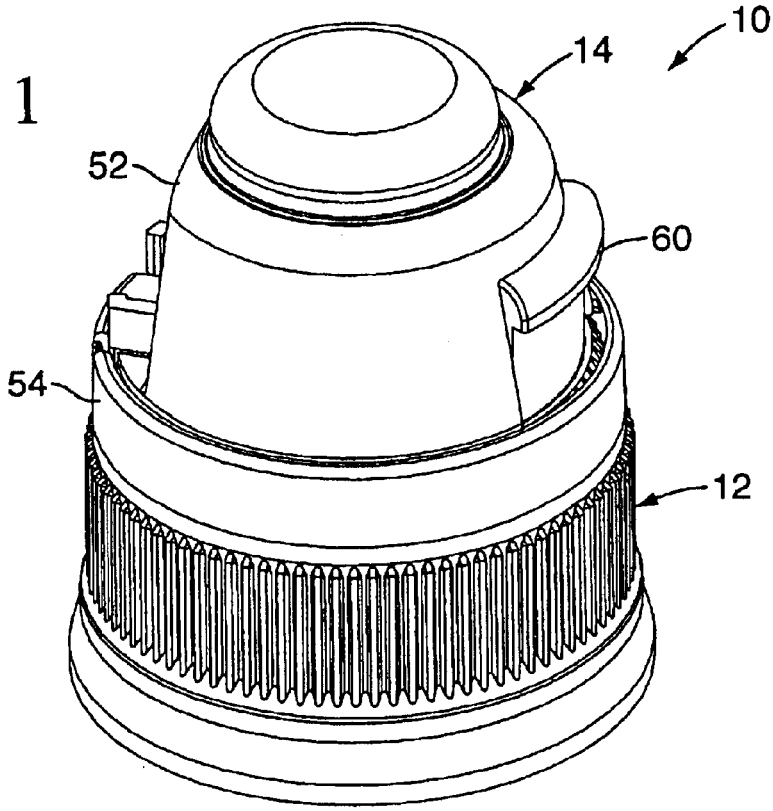
FIG. 1 is a perspective view of a dispensing closure assembly embodying the principles of the present invention.
Figure 2:
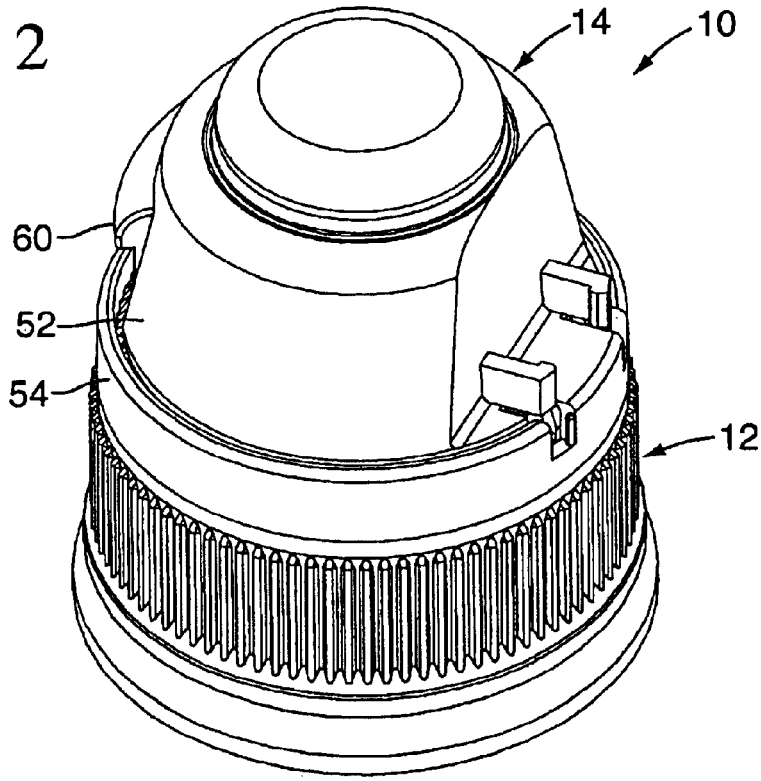
FIG. 2 is another perspective view of the dispensing closure assembly of the present invention.
Figure 3:
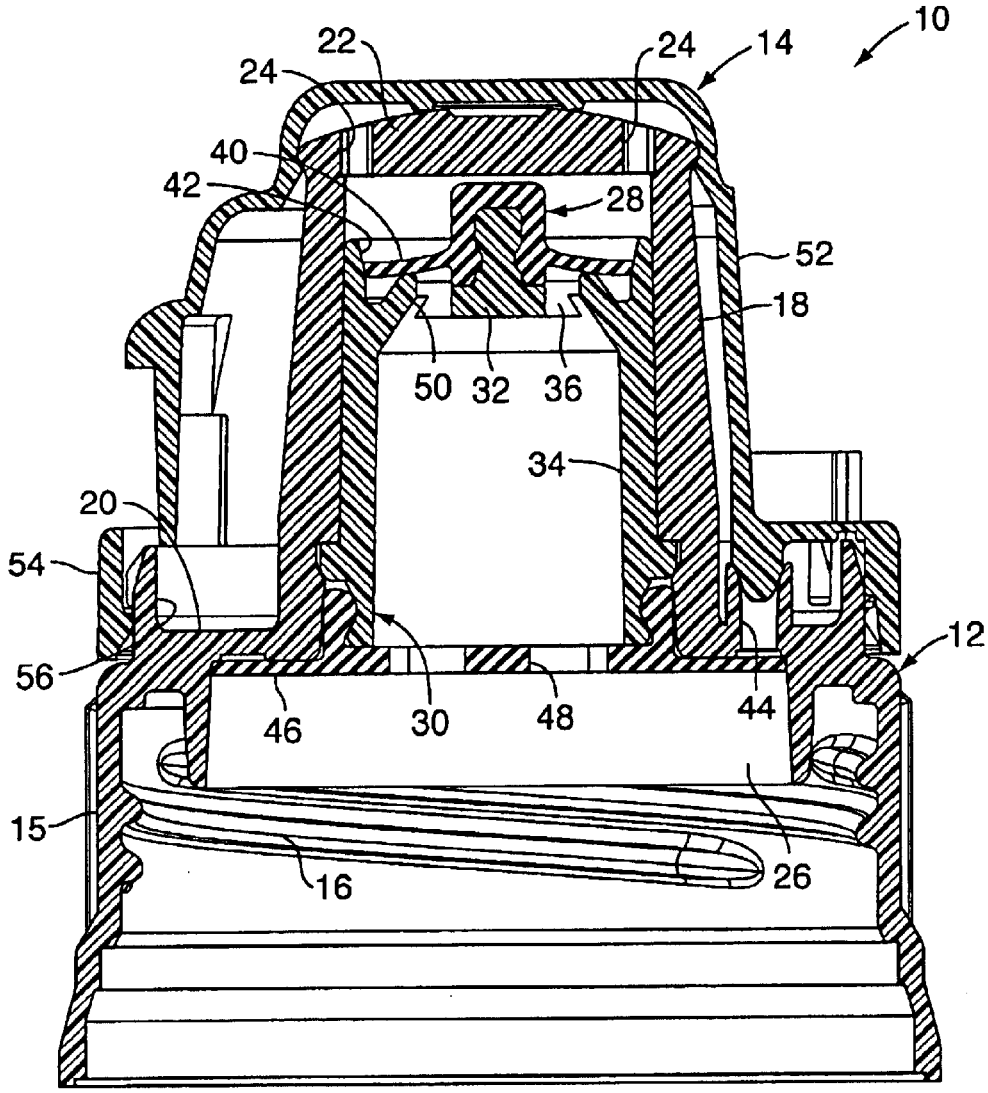
FIG. 3 is a cross-sectional view of the present dispensing closure assembly.
Figure 4:
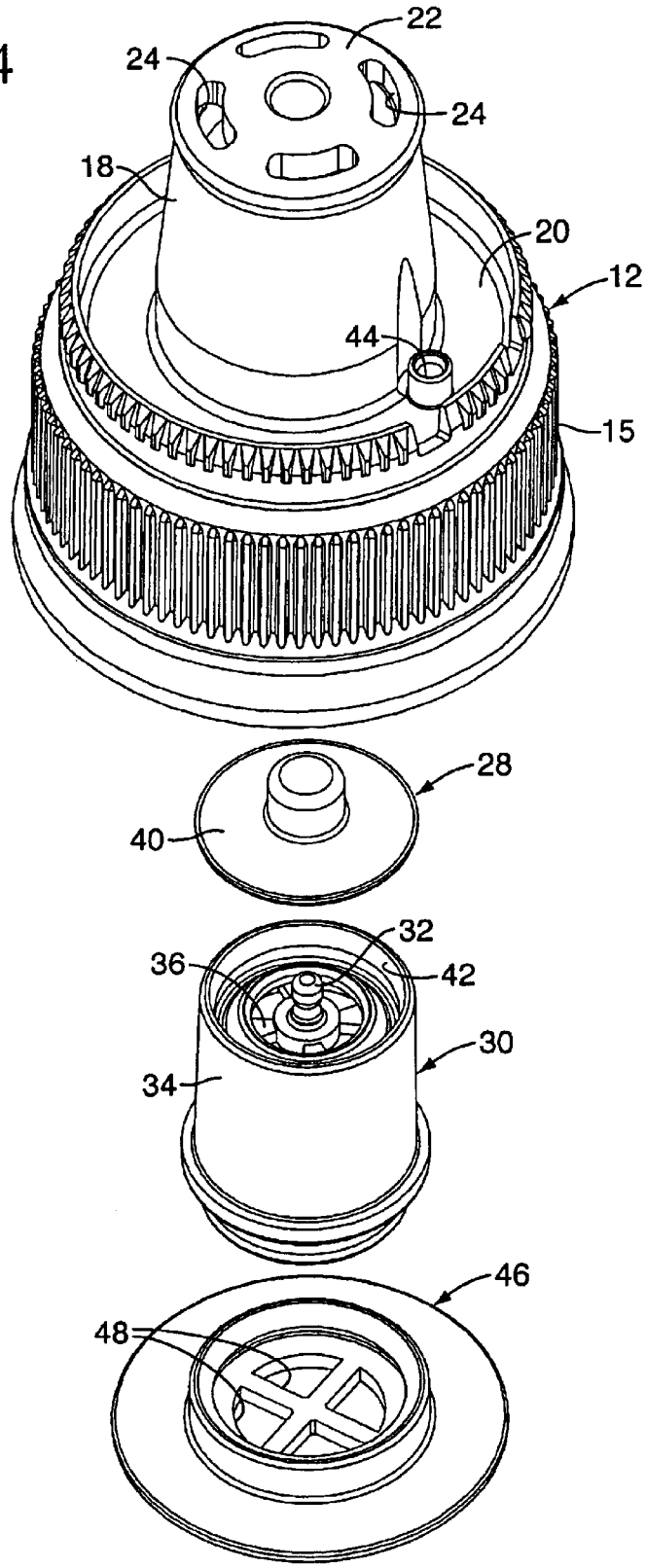
FIG. 4 is a partial, exploded perspective view of the present dispensing closure assembly.
Figure 5:
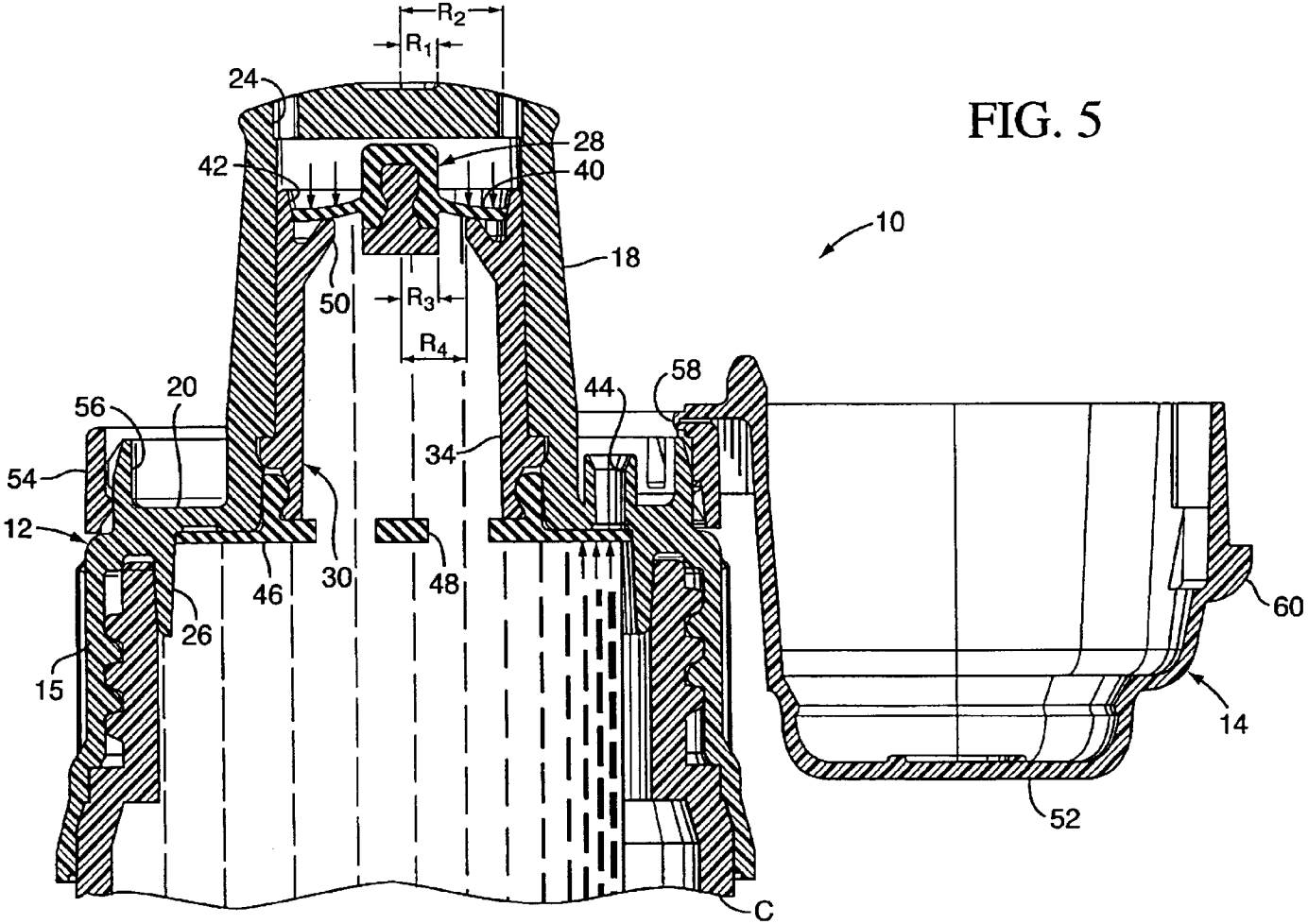
FIG. 5 is a cross-sectional view of the present closure assembly illustrating a dust cover of the assembly in an open condition.

While the present invention is susceptible of embodiment in various forms, there is shown in the drawings, and will hereinafter be described, presently preferred embodiments, with the understanding that the present disclosure is to be considered as an exemplification of the invention, and is not intended to limit the invention to the specific embodiment illustrated.

As will now be described, the present dispensing closure assembly can be provided in various configurations, but with each providing the desired flow characteristics. In each of the illustrated embodiments, an outer closure body includes an upper tubular portion, and a lower skirt portion configured for attachment to an associated container. A central support stem is positioned within the tubular portion of the closure body, with a flexible valve member positioned in the tubular portion. In certain embodiments, the flexible valve member is generally disc-shaped, while in an alternate embodiment, the valve member is generally annular, i.e., ring-shaped.

In accordance with each of the embodiments, one of the support stem and the tubular portion of the closure body define an annular valve seat. The flexible valve member extends from the other of the support stem and tubular portion and bears against the valve seat in a first, closed position of the flexible valve member.

The flexible valve member in each of the embodiments is movable from the first closed position to a second position, wherein at least a portion of the periphery of the valve member is spaced from the valve seal to permit flow through the tubular portion. In those embodiments including a disc-shaped flexible valve member, the valve member extends outwardly from the support stem to the valve seat defined by the tubular portion. In these embodiments, liquid flows generally about the outer periphery of the valve member, with liquid flow out of the closure assembly being somewhat annular in form. In the illustrated embodiment wherein the flexible valve member is annular-shaped, liquid flow from the container is through the central opening at the inner periphery of the valve member, with the valve member extending inwardly from the tubular portion to a valve seat defined by the central support stem. This configuration provides liquid flow in a generally stream-like form.

With reference now to the drawings, therein is illustrated a dispensing closure assembly 10 embodying the principles of the present invention. As will be further described, this embodiment of the present dispensing closure assembly includes an outer closure body 12 configured for attachment or mounting on an associated container, and a dust cover 14 which can be selectively opened to permit dispensing of liquid through the present closure assembly.

With particular reference to FIGS. 3 through 8, the features of the present closure assembly which facilitate dispensing of liquid and convenient use by consumers will now be described. Outer closure body 12 includes a lower skirt portion 14 preferably including an internal thread formation 16, or other suitable attachment lugs or the like for facilitating securement and attachment of the present closure assembly to an associated container C. The outer closure body further includes an upper tubular portion 18, which generally functions as the mouthpiece of the closure assembly, with the upper tubular portion 18 joined to the skirt portion 12 by a generally horizontal deck 20. While the specific configuration of the tubular portion 18 can vary in accordance with specific applications of the present closure assembly, this illustrated embodiment includes an integral orifice plate 22 defining a plurality of dispensing orifices 24 through which liquid flows as it passes through and out of tubular portion 18.

The outer closure body 12 may include a plug element 26, depending generally from deck 20, for disposition within the mouth of the associated container.

Flow of liquid through the tubular portion 18 of the outer closure body is controlled by the creation of a pressure differential on a valve member 28 positioned within the tubular portion 18. In particular, the present closure assembly includes a valve retainer 30 having a valve stem 32 upon which valve member 28 is retained. In this illustrated embodiment, the valve retainer is formed separately from the closure body 12, and thus includes a tubular portion 34 which is retained within the tubular portion 18 of the closure body 12 by a cooperating flange and groove arrangement, as illustrated. The valve retainer includes at least one radially oriented bridge element 36 (four being illustrated) for joining the support stem 32 to the outer tubular portion 34.

The valve member 28 includes a central portion fitted to the valve stem 32, and a generally annular, disc-like portion 40 which is movable relative to a peripheral valve seat 42 defined by retainer element 30 within the tubular portion 18 of the closure body 12. By this arrangement, the valve member is movable from a first, closed position in which the valve member bears against the valve seat (see FIGS. 1, 5, and 8), to a second, opened position wherein at least a portion of the periphery of the valve member is spaced from the valve seat 42 to permit flow through the tubular portion 18 of the closure body (see FIGS. 6 and 7).

In this embodiment of the present closure assembly, which is particularly suited for dispensing of beverages, it is preferred to provide an arrangement for venting air into the associated container as liquid is sucked through the closure assembly by a consumer. To this end, the closure body 12 defines a vent passage 44 extending generally through deck 20 of the closure body. In order to prevent liquid within the associated container from flowing outwardly through the air vent passage 44, the present closure assembly preferably includes a generally disc-shaped vent seal member 46 positioned generally beneath deck 20 of the outer closure body 12. The vent seal member is preferably formed with a suitable annular flange for fitment between retainer element 30 and tubular portion 18 of the closure body, with the vent seal member 46 defining at least one flow passage 48 (four being illustrated) through which liquid flows outwardly through the closure assembly. By virtue of the flexible nature of the vent seal member, the vent seal member closes vent passage 44 under the influence of internal pressure within the container, but permits air to flow into the container through the vent passage when the vent seal member moves away from the vent passage under the influence of a pressure differential acting thereagainst (see FIG. 6). As will be appreciated, this configuration of the vent seal member facilitates venting of air into the container when a consumer sucks liquid through the closure assembly, thus facilitating continuous and uninterrupted flow of liquid, without collapsing or the like of the container. In contrast, the vent seal member acts to close the vent passage 44 when liquid is dispensed by squeezing of the container, thus precluding liquid from flowing out of the vent passage as it flows through the tubular portion 18 and out of the closure assembly.

A notable feature of the present closure assembly is the arrangement by which dispensing of liquid either by application of suction or squeezing of the container C is facilitated, while leakage of liquid from the container attendant to normal handling is avoided. To this end, the closure assembly includes a liquid seal lip 50 which extends inwardly of valve seat 42 for engagement with portion 40 of flexible valve member 28 intermediate support stem 32 and valve seat 42. In this illustrated embodiment, the liquid seal lip 50 is integral with the retainer element 30. By this arrangement of the liquid seal lip, the surface area of the valve member against which liquid pressure within the container acts is limited. By selecting the specific geometry of the valve member and the liquid seal lip 50, as well as by selecting the material from which the valve member is formed, the present closure assembly can be configured so as to facilitate convenient and comfortable dispensing of liquid by suction, or by squeezing of the container C, while avoiding inadvertent and undesirable leakage from the container attendant to normal handling.

The manner in which the liquid seal lip 50 cooperates with the valve member 28 is a function of the different surfaces of the valve member which are exposed to pressures outside of and within the closure assembly. The suction area of the valve member 28, which is exposed to suction by the consumer, is defined by a radius $R_1$ and a radius $R_2$, generally corresponding to the radii of the inner and outer margins of the flexible annular portion of the valve member 28 (see FIG. 5). In contrast, the area of the valve member which is exposed to internal liquid pressure within the container C is defined by radius $R_3$ (equal to $R_1$ in this illustrated embodiment) and radius $R_4$, that is , the distance between a centerline of the valve member 28 and the liquid seal lip 50. Thus, the valve member 28 defines an upper pressure-reactive surface having an inside radius $R_1$ and an outside radius $R_2$ which corresponds to an inside diameter of valve seat 42. The valve member 28 further defines a lower reactive surface having an inside radius $R_3$ and an outside radius $R_4$ generally corresponding to an inside radius of the liquid seal lip 50. By this arrangement, the upper pressure-reactive surface area exposed to suction equals $\pi(R_2^2-R_1^2)$, and the lower pressure-reactive surface exposed to liquid pressure equals $\pi(R_4^2-R_3^2)$. In the illustrated arrangement, $R_1$ equals $R_3$, and the upper pressure-reactive surface area is equal to the area of the valve member 28 exposed to atmospheric pressure. This is because the seal lip 50 is designed to form a liquid seal only, with the interior surface of the valve member 28 always minimally exposed to atmospheric pressure.

Thus, the liquid seal lip 50 acts to limit the area of the valve member 28 which is exposed to internal liquid pressure from the container C, with the area exposed to internal liquid pressure being substantially less than the area exposed to suction. By virtue of the configuration of the liquid seal lip 50 to only seal against liquid, it will be appreciated that the area of the valve member 28 exposed to suction is equal to the area of the valve member exposed to atmospheric pressure.

Since the valve opening force and the area exposed to atmospheric pressure are determined by design geometry and valve material selection, the suction pressure ($P_{suction}$) necessary to open the valve can be calculated. $P_{suction}$ is solely a function of the valve opening force, radii $R_1$ and $R_2$, and atmospheric pressure.

The surface area of the movable portion of the valve member 28 that is exposed to internal liquid pressure is defined by radii $R_3$ and $R_4$, where the radius $R_4$ is defined by the position at which the liquid seal lip 50 engages the lower surface of the valve member 28.

The valve opening pressure threshold due to internal liquid pressure is then:

$$P_{liquid} - P_{atm} = \frac{\text{valve opening force}}{\text{area exposed to internal liquid pressure}}$$

Since the valve opening force and the area exposed to internal liquid pressure are determined by design geometry and design material selection, the liquid pressure ($P_{liquid}$) necessary to open the valve can be calculated. $P_{liquid}$ is solely a function of the valve opening force, radii $R_3$ and $R_4$, and atmospheric pressure.

As will be evident, the present invention allows the valve opening pressure threshold due to suction and internal liquid pressure to be substantially different. Moreover, the present invention allows the difference in thresholds to be adjusted through geometry, specifically, by selection of radii $R_1$, $R_2$, $R_3$ and $R_4$.

The valve opening pressure threshold due to internal liquid pressure must be designed (through geometry and valve material properties) to be substantially greater than the internal liquid pressures encountered in normal use (i.e., caused by temperature change, bottle orientation, vibration, normal handling, etc.). When this is achieved, the valve will not leak liquid under normal use conditions, but will still actuate via comfortable suction applied by a consumer, and via squeezing of the package by the consumer, provided that the liquid pressure that is generated by a comfortable level of squeezing exceeds the valve opening threshold due to liquid pressure.

Figure 6:
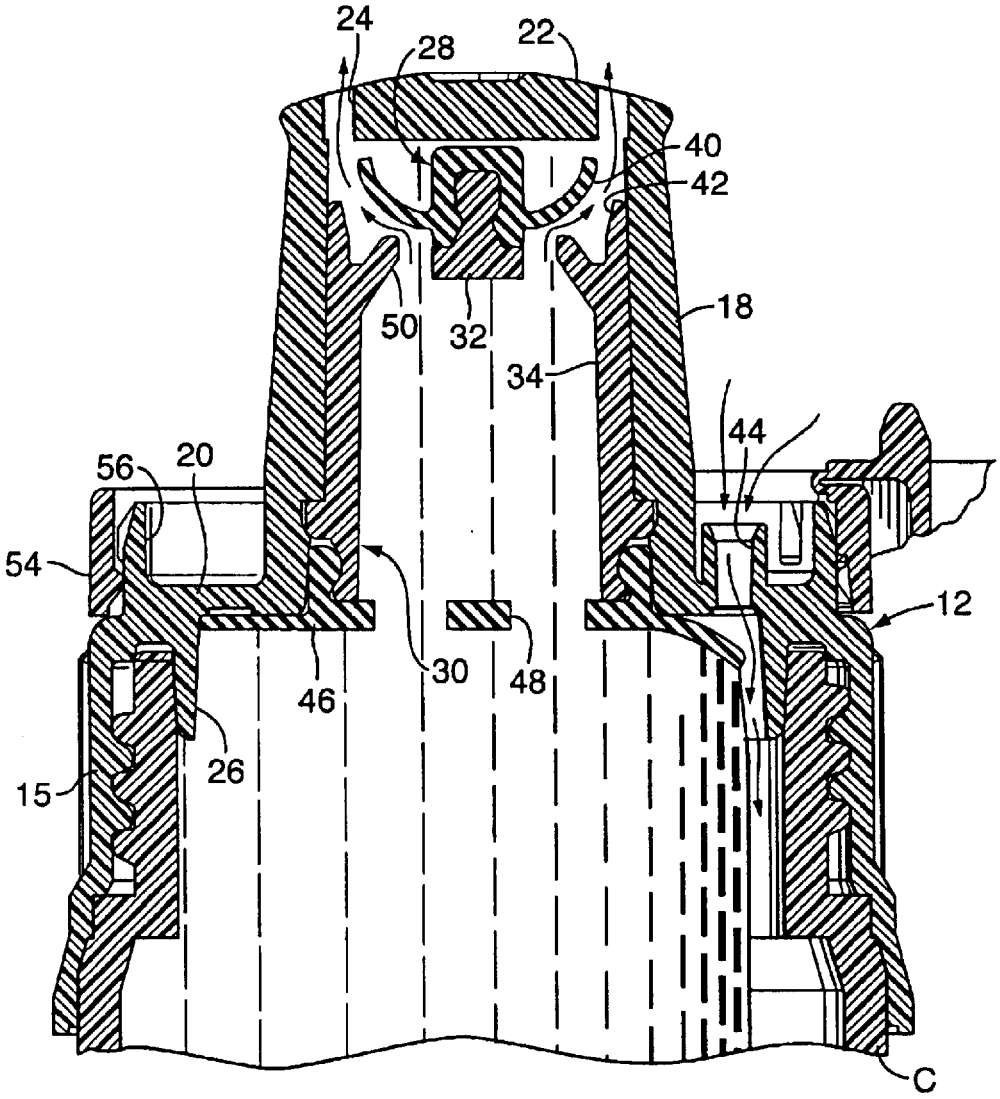
FIG. 6 is a cross-sectional view similar to FIG. 5 illustrating dispensing of liquid through the present dispensing closure assembly by the application of suction thereto.
Figure 7:
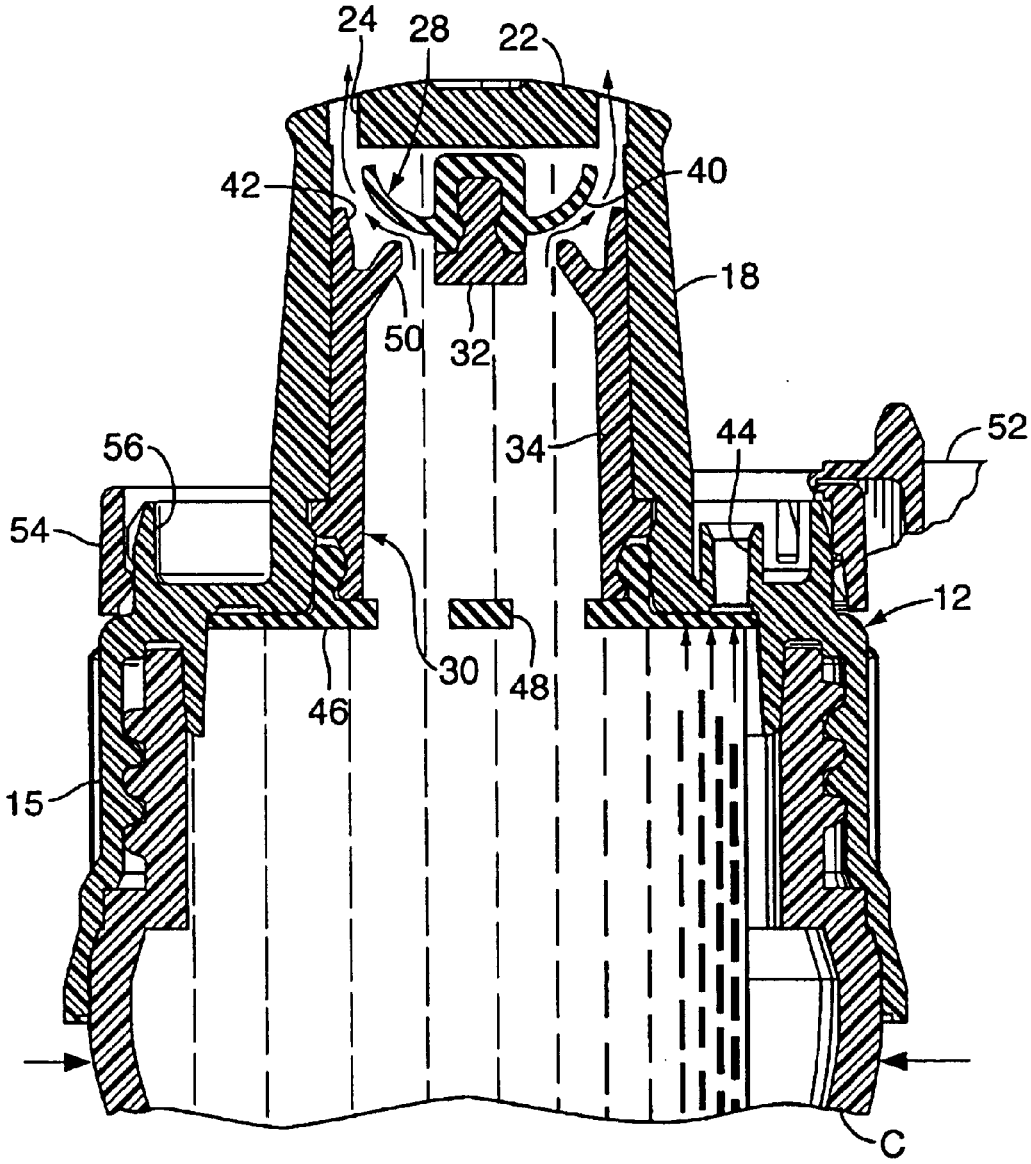
FIG. 7 is a cross-sectional view of the present closure assembly illustrating dispensing of liquid by creating an increase in internal liquid pressure by squeezing of the associated container.
Figure 8:
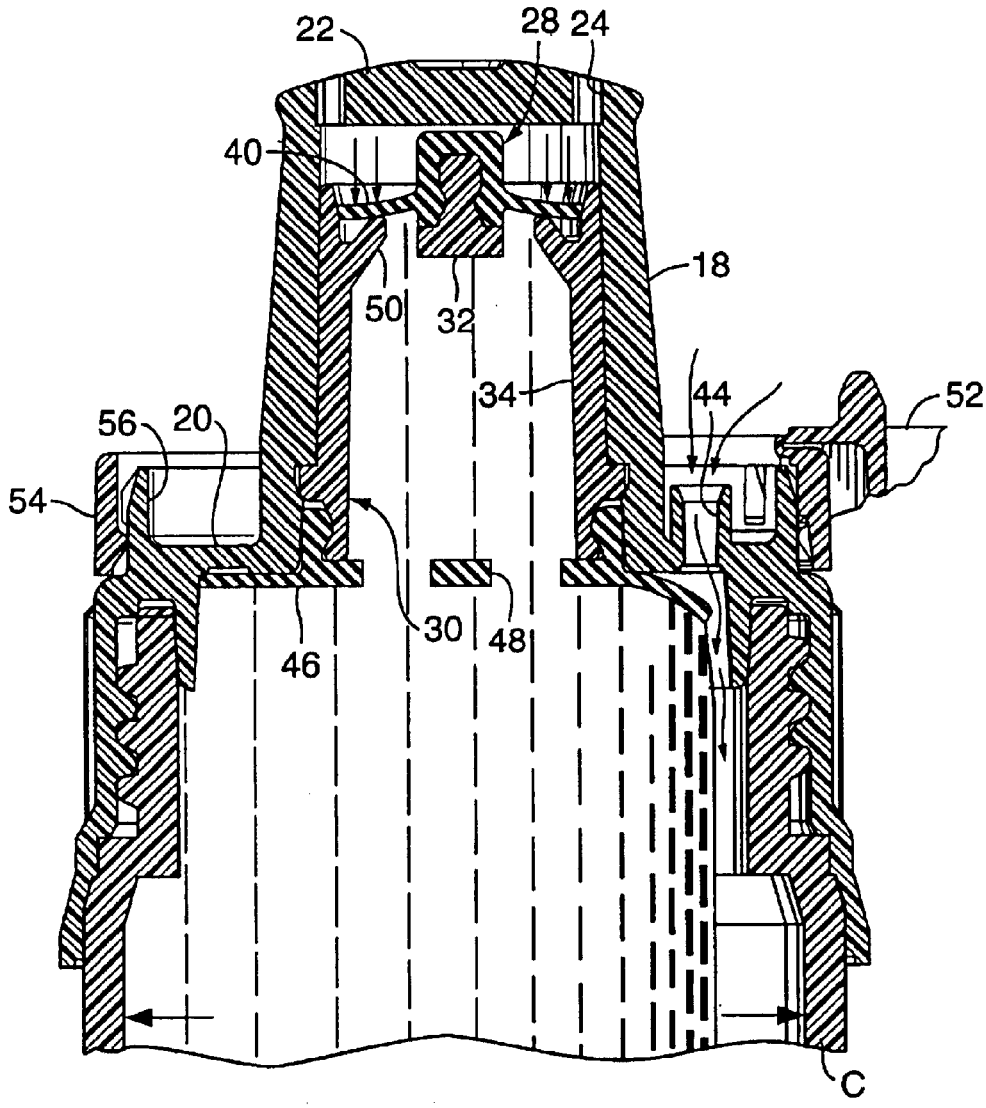
FIG. 8 is a cross-sectional view of the present dispensing closure assembly illustrating venting of air through the present closure assembly.
Figure 9:
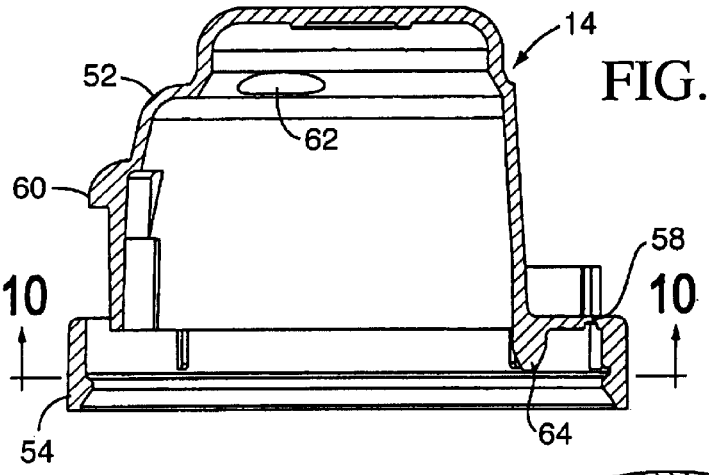
FIG. 9 is a cross-sectional view of the dust cover of the present closure assembly.
Figure 10:
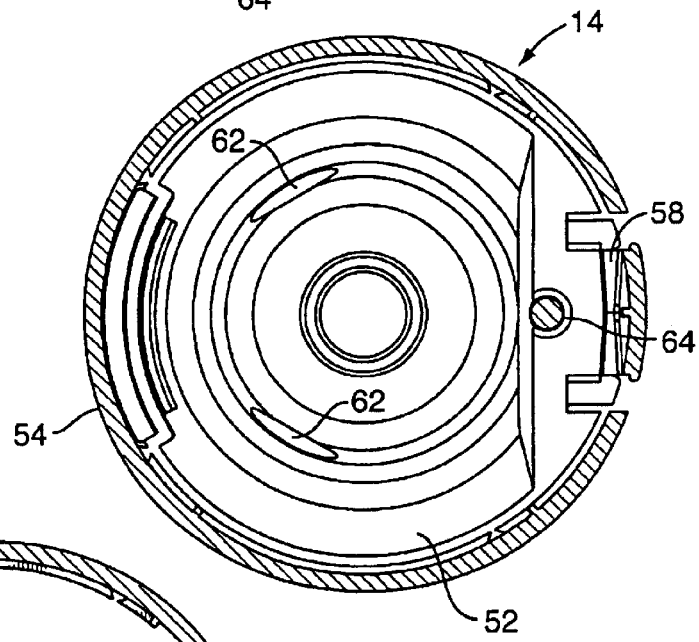
FIG. 10 is a cross-sectional view taken generally along lines 10—10 of FIG. 9, illustrating the interior of the dust cover of the present closure assembly.
Figure 11:
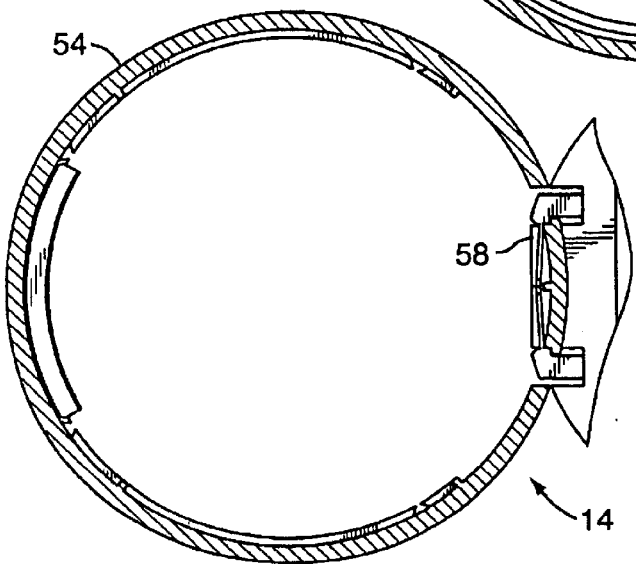
FIG. 11 is a further cross-sectional view illustrating a mounting ring of the dust cover of the present closure assembly.

The different modes of operation of the present closure assembly are illustrated in FIGS. 6, 7, and 8. FIG. 6 illustrates the closure assembly, dispensing liquid under the influence of suction applied by a consumer. Liquid from within container C flows through openings 48 in vent seal member 46, through the tubular portion 34 of retainer 30 within the tubular portion 18 of the container body, around the flexed valve member 28, and outwardly through openings 24 for consumption. As liquid is consumed, air flows through vent passage 44 and around the flexed portion of vent seal member 46 into the container C.

FIG. 7 illustrates dispensing of liquid by squeezing of container C. Again, liquid flows outwardly through openings 48 in vent seal member 46, through retainer element 30 and tubular portion 18 of the closure body, around the flexed valve member 28, and outwardly through openings 24. As will be observed, in this mode of dispensing, liquid pressure within the container acts against vent seal member 46 to urge the vent seal member to a closed position covering vent passage 44, thus preventing liquid from flowing outwardly through the vent passage.

FIG. 8 illustrates the passage of air into the now-released container C, as the resilience of the container acts to restore the container to its original configuration after it has been squeezed. Air flows through vent passage 44, and around the flexed portion of vent seal member 48, thus restoring the container to its original configuration. Atmospheric pressure acting against the flexible portion of valve member 28 urges the valve member to its closed disposition in engagement with valve seat 42.

In accordance with a presently preferred embodiment, dispensing closure assembly 10 includes dust cover 14 joined to the outer closure body 12 for generally covering the mouthpiece provided by tubular portion 18 when the closure is not in use. To this end, the dust cover 14 includes a cover portion 52 which is movable between a closed position covering the upper tubular portion 18 (FIG. 3) and an open position exposing the upper tubular portion for use (see FIG. 5). In this embodiment, the dust cover 14 is formed separately from the closure body 12, and thus includes a mounting ring 54 for snap fitment to an upstanding flange 56 of the outer closure body 12. A suitable living hinge 58 hingedly joins the cover portion 52 to the mounting ring 56. The hinge 58 may be configured as a so-called "butterfly hinge", such as illustrated in U.S. Pat. No. 4,403,712, hereby incorporated by reference. Convenient manipulation of the cover portion 52 is facilitated by the preferred provision of a thumb tab 60, with the cover portion preferably including at least one locking element 62 for cooperating engagement with the upper tubular portion 18 of the closure body for releasably retaining the cover portion in its closed position. It is also preferred that the cover portion 52 include a vent block element 64 for closing vent passage 44 in the closed position of the cover portion, thus acting to further preclude the possible leakage of liquid from the container through the vent passage.

Figure 12:
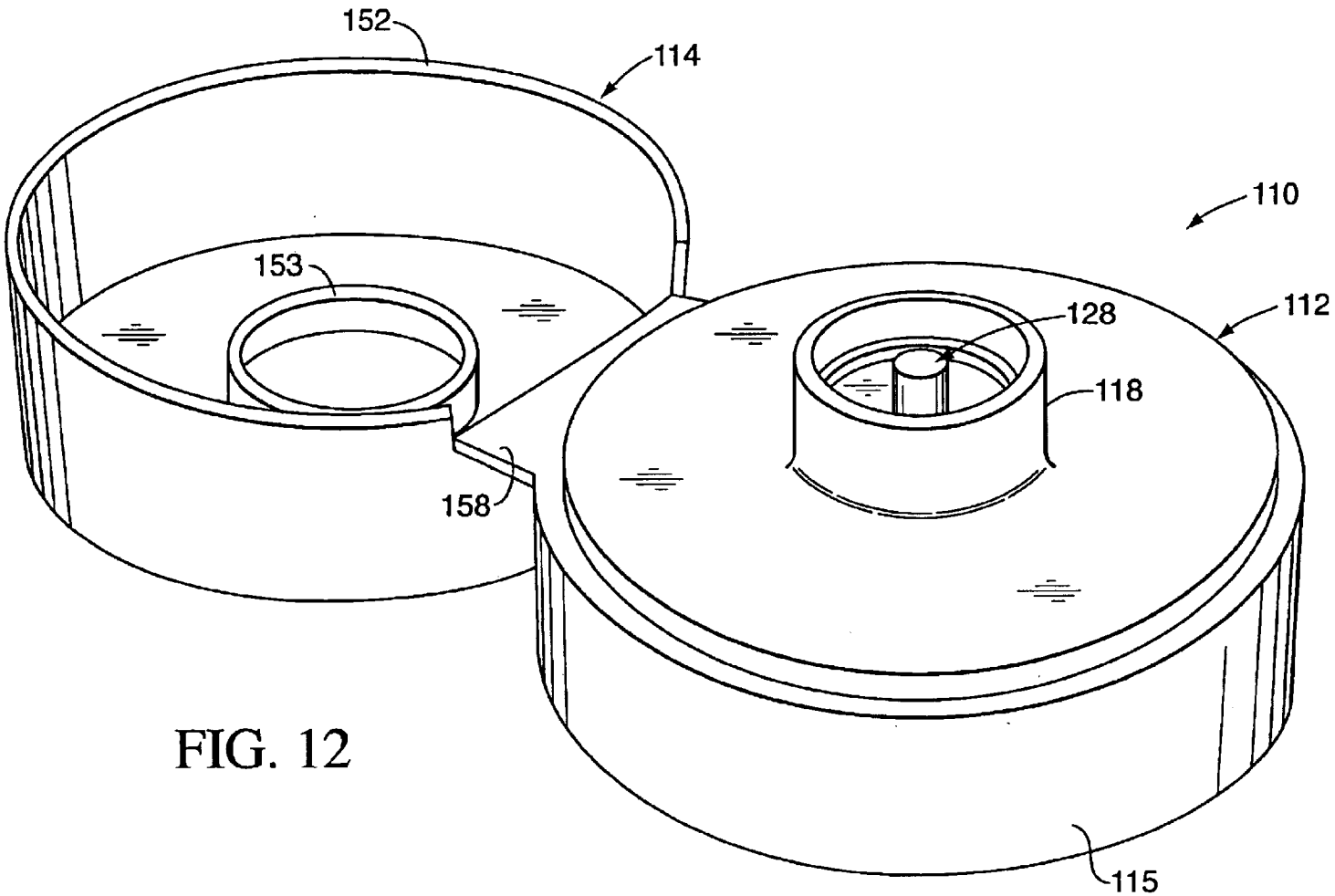
FIG. 12 is a perspective of an alternate embodiment of the present closure assembly suited for dispensing condiments and like flowable liquids.
Figure 13:
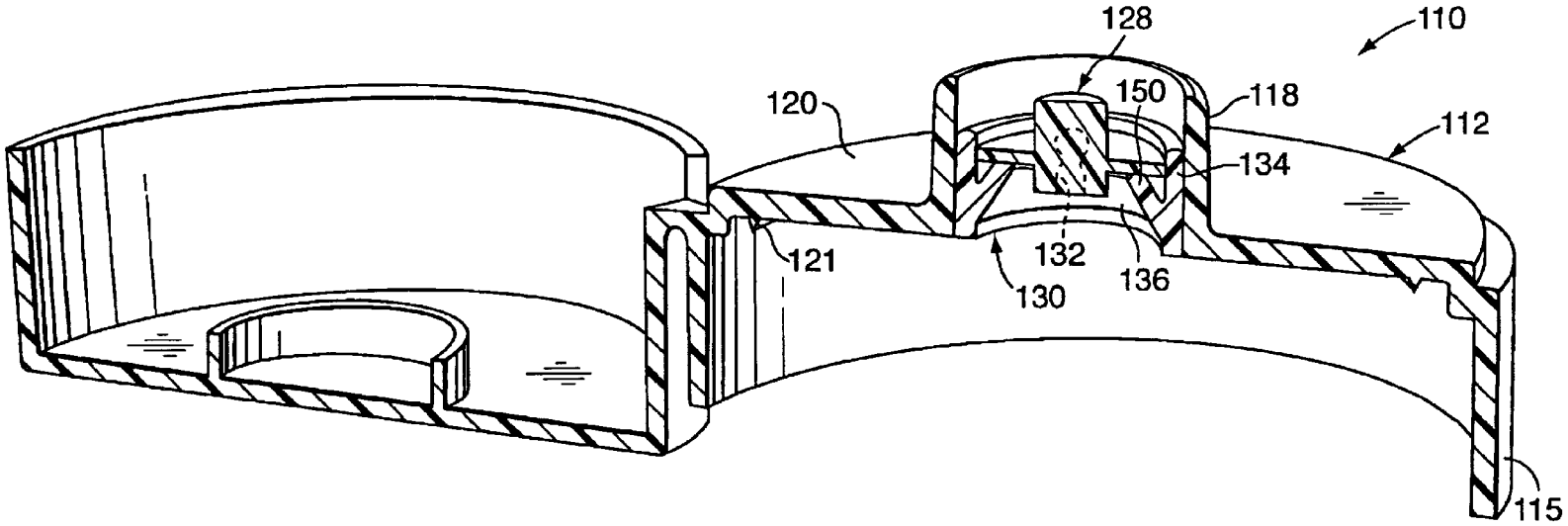
FIG. 13 is a cross-sectional view of the dispensing closure embodiment shown in FIG. 12.

With reference now to FIGS. 12 and 13, therein is illustrated an alternative embodiment of the present invention, with elements corresponding to those disclosed in the previous embodiment identified by like reference numerals in the 100-series. Generally, this dispensing closure assembly, designated 110, is of a somewhat more simplified construction, facilitating its cost-effective use. In particular, this closure assembly includes a pivotal cover element which is formed integrally with a closure body, and does not include an associated vent passage such as disclosed in the previous embodiment.

Dispensing closure assembly 110 includes an outer closure body 112 having a skirt portion 115 for attachment of the closure assembly to an associated container. The closure body 112 includes a generally upstanding tubular portion 118 through which liquid is dispensed, with a generally horizontal closure deck 120 extending between the tubular portion 118 and the skirt 115. An annular seal lip 121 depends from the inside surface of the deck 120 for sealing cooperation with an associated container.

As in the previous embodiment, a valve member 128 is positioned within the tubular portion 118 and is movable between closed and open positions with respect to an associated, peripheral valve seat. A valve retainer element 130 is positioned within the tubular portion 118, and includes a tubular portion 34 fitted within the tubular portion 118. The retainer element includes a central support stem 132 (illustrated in phantom line) upon which the valve member 128 is supported. At least one radially oriented bridge 136 extends between the support stem and the tubular portion 134 of the retainer element.

As in the previous embodiment, the retainer element includes a liquid seal lip 150 which engages the valve member 128 intermediate the peripheral valve seat, and the support stem 132.

In this embodiment, a dust cover formed integrally with closure body 112 includes a movable dust cover 152 having a depending annular flange 153 which cooperates with tubular portion 118 to act to retain the cover portion in a closed position with respect to the closure body 112. The dust cover 152 is movably joined to the closure body 112 by a suitable living hinge 158. As will be appreciated, this embodiment of the present dispensing closure assembly can provide dispensing attendant to application of suction, or the creation of liquid pressure within the associated container, while avoiding leakage as may be encountered during normal handling by the provision of liquid seal lip 150. This type of non-venting closure assembly can be suitable for applications including deformable containers which do not resiliently return to their original configuration after pressure is applied thereto. For applications in which it is desired to permit venting of air back into the associated container, it is contemplated that small lair passage grooves can be provided in the valve seat which is engaged by valve member 128, with such grooves permitting air to vent into the container around the valve member in its closed position.

Figure 14:
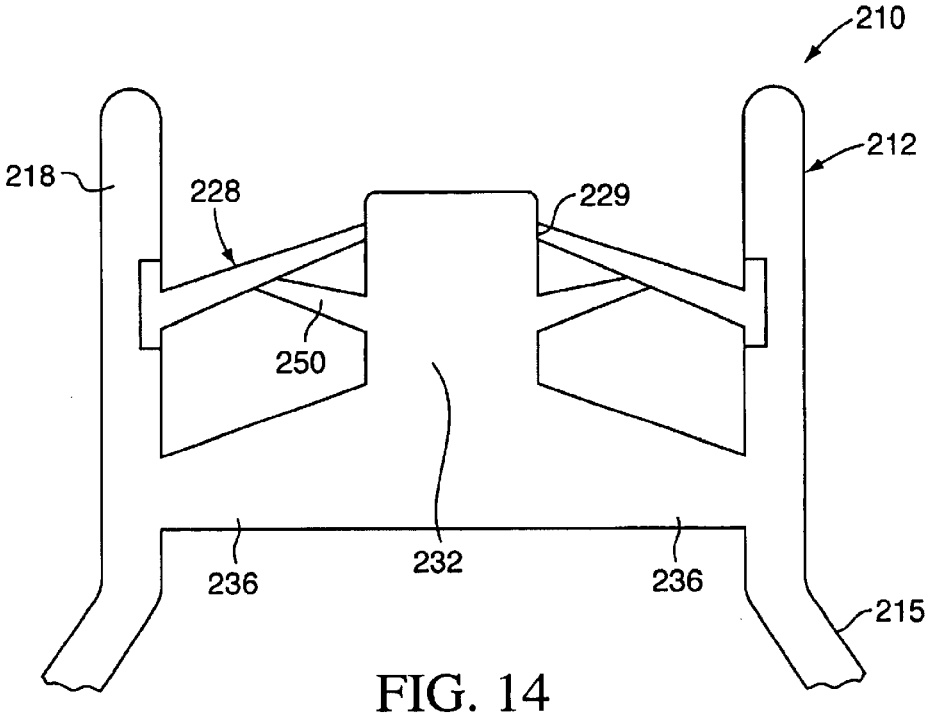
FIGS. 14 and 15 are diagrammatic views of a further embodiment of the present dispensing closure.
Figure 15:
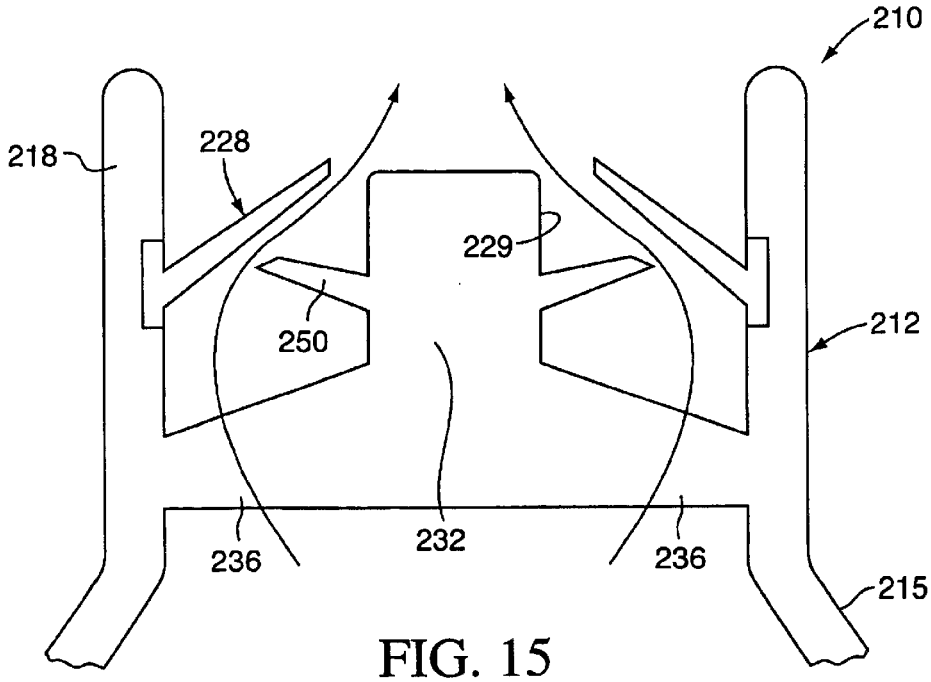

FIGS. 14 and 15 illustrate a further alternative embodiment of the present invention, with elements corresponding to those disclosed in the previous embodiments identified by like reference numerals in the 200-series. This embodiment differs from the previously described embodiments in that liquid flow from the closure assembly is through a central opening defined by a generally annular, ring-shaped flexible valve member.

With reference to FIGS. 14 and 15, dispensing closure assembly 210 includes an outer closure body 212 having a skirt portion 215 for attachment of the closure assembly to an associated container. The closure body 212 includes a generally upstanding tubular portion 218 through which liquid is dispensed.

A flexible valve member 228, having a generally ring-shaped configuration, is positioned within the tubular portion 218, and is movable between closed and open positions with respect to an associated annular valve seat 229 defined by a central support stem 232 positioned generally within tubular portion 218. The central support stem 232 includes at least one radially extending bridge 236, with liquid flow from the container being provided between and around the radial bridges 236.

FIG. 14 illustrates flexible valve member 228 in a closed position thereof, wherein the valve member bears against valve seat 229. In contrast, FIG. 15 illustrates the flexible valve member 228 in its opened position, wherein the valve member has moved out of engagement with the valve seat 229, thus permitting flow of liquid from within the container.

In accordance with the present invention, this embodiment of the present closure assembly includes a liquid seal lip 250 which extends from the central support stem 232 for engagement with the flexible valve member intermediate the valve seat 229 and the tubular portion 218. By this arrangement, the liquid seal lip 250 acts to limit the surface area of the valve member 228 against which liquid pressure within the container acts. As noted, this embodiment of the present invention differs from the previously described embodiments in that liquid flow is generally stream-like in nature, as liquid from within the container flows through the central opening defined at the inner periphery of the flexible valve member 228. As in the previous embodiment, for those applications in which it is desired to permit venting of air back into the associated container, it is contemplated that small air passage grooves can be provided in the valve seat 229, with such grooves permitting air to vent into the container around the valve member 228 in its closed position.

From the foregoing, it will be evident that numerous modifications and variations of the invention will be readily apparent to those skilled in the art. The invention is intended to cover all such modifications as fall within the scope of the claims.

What is claimed is:

1. A dispensing closure assembly for a container, comprising:

an outer closure body including an upper tubular portion, and a lower skirt portion configured for attachment to an associated container;

a valve retainer comprising a central support stem positioned within said tubular portion;

a flexible valve member positioned on said support stem and extending from said support stem outwardly to a peripheral valve seat within said tubular portion spaced from said support stem, said valve member being movable from a first closed position in which said valve member bears against said valve seat, to a second position wherein at least a portion of the periphery of said valve member is spaced from said valve seat to permit flow through said tubular portion; and a liquid seal lip extending inwardly of said valve seat for engagement with said flexible valve member intermediate said support stem and said valve seat, in spaced relationship to said valve seat, to define an inner surface of said valve member isolated from an interior of said container when said valve member is in said closed position, to limit the surface area of said valve member against which liquid pressure within said container acts.

2. A dispensing closure assembly in accordance with claim 1, wherein:

said valve member extends generally downwardly from said support stem to said valve seat in said closed position.

3. A dispensing closure assembly in accordance with claim 2, wherein:

said valve member is generally conic.

4. A dispensing closure assembly in accordance with claim 1, wherein:

said valve retainer comprises an outer tubular portion and includes at least one radially oriented bridge.

5. A dispensing closure assembly in accordance with claim 1, wherein:

said valve member defines an upper pressure-reactive surface having an inside radius $R_1$, and an outside radius $R_2$, which corresponds to an inside diameter of said valve seat, said valve member defining a lower reactive surface having an inside radius $R_3$, and an outside radius $R_4$, generally corresponding to an inside radius of said liquid seal lip, whereby the upper pressure-reactive surface area exposed to suction equals $\pi(R_2^2-R_1^2)$, and said lower pressure-reactive surface exposed to liquid pressure equals $\pi (R_4^2 - R_3^2)$.

6. A dispensing closure assembly in accordance with claim 5, wherein:

$R_1$ equals $R_3$, and said upper pressure-reactive surface area is equal to an area of said valve member exposed to atmospheric pressure.

7. A dispensing closure assembly in accordance with claim 1, including:

a dust cover joined to said outer closure body comprising a cover portion for movement between a closed position covering said upper tubular portion, and an open position exposing said upper tubular portion.

8. A dispensing closure assembly in accordance with claim 7, wherein:

said dust cover includes a mounting ring for snap fitment to said outer closure body, said cover portion being hingedly joined to said mounting ring.

9. A dispensing closure assembly in accordance with claim 8, wherein:

said cover portion includes at least one locking element for cooperating engagement with said upper tubular portion of said closure body to releasably retain said cover portion in said closed position thereof.

10. A dispensing closure assembly in accordance with claim 1, wherein:

said lower skirt portion includes an internal thread formation.

11. A dispensing closure assembly for a container, comprising:

an outer closure body including an upper tubular portion, and a lower skirt portion configured for attachment to an associated container;

a central support stem positioned within said tubular portion;

a flexible valve member positioned in said tubular portion, one of said support stem and said tubular portion defining an annular valve seat, said flexible valve member extending from the other of said support stem and tubular portion and bears against said valve seat in a first, closed position of said flexible valve member, said valve member being movable from said first closed position to a second position wherein at least a portion of the periphery of said valve member is spaced from said valve seat to permit flow through said tubular portion; and a liquid seal lip extending from said one of said support stem and said tubular portion for engagement with said flexible valve member intermediate: (1) the other of said support stem and tubular portion; and (2) said valve seat, in spaced relationship to said valve seat, to define an inner surface of said valve member isolated from an interior of said container when said valve is in said closed position, to limit the surface area of said valve member against which liquid pressure within said container acts.

12. A dispensing closure assembly in accordance with claim 11, wherein:

said flexible valve member is disc-shaped and extends outwardly from said support stem to said valve seat defined by said tubular portion.

13. A dispensing closure assembly in accordance with claim 11, wherein:

said flexible valve member is annular and defines a central opening at said periphery, said valve member extending inwardly from said tubular portion to said valve seat defined by said support stem.

14. A dispensing closure in accordance with claim 11, wherein:

said support stem includes at least one radially oriented bridge extending to said tubular portion.

15. A dispensing closure assembly for a container, comprising:

an outer closure body including an upper tubular portion, and a lower skirt portion configured for attachment to an associated container;

a valve retainer comprising a central support stem positioned within said tubular portion;

a flexible valve member positioned on said support stem and extending from said support stem outwardly to a peripheral valve seat within said tubular portion, said valve member being movable from a first closed position in which said valve member bears against said valve seat, to a second position wherein at least a portion of the periphery of said valve member is spaced from said valve seal to permit flow through said tubular portion; and a liquid seal lip extending inwardly of said valve seat for engagement with said flexible valve member intermediate said support stem and said valve seat to limit the surface area of said valve member against which liquid pressure within said container acts, wherein said outer closure body defines an air vent passage for venting air into said container during liquid flow outwardly through said upper tubular portion, said closure assembly including a vent seal member positioned beneath said upper tubular portion for closing said air vent passage.

16. A dispensing closure assembly for a container, comprising:

an outer closure body including an upper tubular portion, and a lower skirt portion configured for attachment to an associated container;

a valve retainer comprising a central support stem positioned within said tubular portion;

a flexible valve member positioned on said support stem and extending from said support stem outwardly to a peripheral valve seat within said tubular portion, said valve member being movable from a first closed position in which said valve member bears against said valve seat, to a second position wherein at least a portion of the periphery of said valve member is spaced from said valve seal to permit flow through said tubular portion; and a liquid seal lip extending inwardly of said valve seat for engagement with said flexible valve member intermediate said support stem and said valve seat to limit the surface area of said valve member against which liquid pressure within said container acts, wherein said outer closure body defines an air vent passage for venting air into said container, said closure assembly including a dust cover joined to said closure body comprising a cover potion for movement between a closed position covering said upper tubular portion, and an open position exposing said tubular portion, said dust cover including a vent block element for closing said vent passage in said closed position of said cover portion.

* * * * *